US006175687B1

(12) United States Patent
Imamura et al.

(10) Patent No.: US 6,175,687 B1
(45) Date of Patent: Jan. 16, 2001

(54) HUMIDIFIER AND HOLLOW YARN BODY TO BE USED THEREFOR

(75) Inventors: Toshihide Imamura; Kanichi Kadotani, both of Kanagawa-ken (JP)

(73) Assignee: Kabushiki Kaisha Komatsu Seisakusho, Tokyo (JP)

( * ) Notice: Under 35 U.S.C. 154(b), the term of this patent shall be extended for 0 days.

(21) Appl. No.: 08/318,726

(22) PCT Filed: Apr. 28, 1993

(86) PCT No.: PCT/JP93/00568

§ 371 Date: Oct. 13, 1994

§ 102(e) Date: Oct. 13, 1994

(87) PCT Pub. No.: WO93/22604

PCT Pub. Date: Nov. 11, 1993

(30) Foreign Application Priority Data

Apr. 30, 1992 (JP) ..... 4-135737
Nov. 30, 1992 (JP) ..... 4-320342

(51) Int. Cl.[7] ..... F22B 29/00
(52) U.S. Cl. ..... 392/395; 392/397
(58) Field of Search ..... 392/395–398; 122/366; 261/139, 142, 94, 99, DIG. 65

(56) References Cited

U.S. PATENT DOCUMENTS 1,643,439 * 9/1927 Aske ..... 392/395
3,869,242 * 3/1975 Schladitz ..... 392/395
4,748,314 * 5/1988 Desage ..... 392/395
5,014,337 * 5/1991 Desage ..... 392/395

FOREIGN PATENT DOCUMENTS 1238173 4/1967 (DE) .
1679541 4/1971 (DE) .
7127058 10/1971 (DE) .
62-117437 7/1987 (JP) .
63-55966 11/1988 (JP) .
24147 1/1990 (JP) .
2183741 7/1990 (JP) .
431476 7/1992 (JP) .

OTHER PUBLICATIONS

PCT Notification of Transmittal of Copies of Translation of Int. Prel. Examination Report.
International Search Report.

* cited by examiner

*Primary Examiner*—Sang Paik
(74) *Attorney, Agent, or Firm*—Ronald P. Kananen; Rader, Fishman & Grauer

(57) ABSTRACT

A humidifier (5) includes upper and lower water tanks (7) and (8) supported by a support frame (6). In a space between the upper and lower water tank, a plurality of hollow yarn bodies (1) are arranged in communication with upper and lower water tanks. The hollow yarn body is constructed of a parens yarn (2) of the hollow and a thin metal wire (3) connected to the power source thereof and wound around the hollow yarn body.

9 Claims, 4 Drawing Sheets

HUMIDIFIER AND HOLLOW YARN BODY TO BE USED THEREFOR

TECHNICAL FIELD

The present invention relates to a humidifier which forms a part of an air and humidity control system of an air conditioning system of the type suitable for semiconductor fabrication plants and clean rooms, and which can control humidification with super high precision. The invention also relates to a hollow yarn as a humidifying material to be employed in the humidifier.

BACKGROUND ART

A conventional type of humidifier is disclosed in Japanese Examined Utility Model Publication (Kokoku) No. Heisei 4-31476. The humidifier shown in FIG. 7, is such that water is supplied from an illustrated water supply pipe to a water supply pan a. This water is absorbed by a filter material b of a humidifying element c and penetrates downwardly through the humidifying element c. The humidifying element c is arranged so that the filter materials b have a plate-shaped configuration, are adhered on both side surfaces of a metal case e which has an internal hollow space d. Within the internal hollow space d of the case e of the humidifying element c, is a heater f. By energizing of this heater f, the temperature within the hollow space of the humidifying element c is raised. Accordingly, the filter materials b fixed on the humidifying element c are heated. This evaporates the water which has penetrated into the filter material b and humidifies the air.

FIG. 8 shows another type of conventional humidifier. In this arrangement, a water reservoir h is connected to a water supply pipe g, is placed within a warmer box j. A "throw-in" type metal heater i is disposed in the water reservoir h. The water in the water reservoir h is heated by the metal heater i to the level whereat it evaporates and is discharged through an evaporation opening k provided at the upper portion of the water reservoir h to humidify the external air. When the water amount in the water reservoir h is reduced by evaporation, a water level monitoring sensor m actuates an electromagnetic valve n to return the water to its original level.

The first of the above-mentioned prior art arrangements encounters the following drawbacks.

(1) With this humidifying technique, the water is evaporated from the surface of the humidifying element c by transmitting heating energy of the-heater f through heat transmission in order of "heater f→environmental air→case e→filter material b→water". Namely, this method indirectly heats the water.

In addition to overheating and assuring a certain extent of water vapor amount, a given amount of water has to be stored in the filter material b. Therefore, the filter material b has to be relatively large. This inhibits down-sizing and inherently produces large thermal inertia.

Accordingly, a long period is required from the initiation of heating by the heater to the actual evaporation of the water. Also, when the evaporation amount is desired to be varied, a long lag time occurs between the change in heating and the variation of the evaporation. Therefore, humidification control within a short period is difficult.

Furthermore, because of the indirect heating, precise water evaporation volume cannot be achieved.

(2) Since water supply for the filter material b is achieved by the penetration of water into the filter material b from the water supply pan a, the water propagates from the upper portion where the water supply pan a is located, down to the lower portions.

Accordingly, there is a tendency that there is an insufficient supply of water at the lower portions of the filter b. Therefore, once evaporation of the water is initiated by heating with the heater i, the amount of water in the filter material b can become locally deficient and can cause abnormally high temperature regions. Under such conditions, the filter material b may be thermally damaged and, in turn, heat the air passing through the humidifying apparatus.

Additionally, since the water supply is achieved by penetration of water through the filter material b, it is difficult to accurately control the amount of water supplied into the air. It is also possible that the heating energy by the heater exceeds the amount of water which can actually undergo evaporation. Accordingly, the excessive heating may heat the environmental air of the humidifying element c or damage the filter material b.

Due to the possibility of causing heating of the air passing through the humidifier, it is difficult to realize ideal constant temperature humidification for humidifying without heating the environmental air. Accordingly, it is difficult to control the temperature and humidify of the air with high precision.

The second of the above-discussed prior art arrangements suffers from the following problems.

(1) Since all of the water in the water reservoir h has to be heated, thermal inertia is significantly large. Accordingly, start-up characteristics from initiation of heating to actual evaporation is poor. Furthermore, when variation of the evaporation amount is desired, there is inherent long time lag from variation-of the heating amount of the heater i to the variation in the evaporation amount. Accordingly, with this arrangement, precise evaporation amount control is not possible.

(2) Since a relatively large amount of water has to be retained in the water reservoir, a large volume water reservoir h is necessary. Accordingly, the humidified device cannot be rendered compact.

(3) When the water in the water reservoir h is reduced to a predetermined extent by evaporation of the water, the water level monitoring sensor detects this and opens the electromagnetic valve n to supply more water. Therefore, due to the supply of cold water, the temperature of the water reservoir h is lowered and causes a fluctuation in the evaporation amount. Accordingly, precise evaporation amount control is difficult.

Therefore, it is an object of the present invention to provide a humidifier which can quickly perform large scale humidification, can be controlled with high precision, and can be compactly constructed. It is a further object of the invention to provide a humidifier which features a hollow yarn body which is extremely durable, which permits significantly increased water evaporation from the surface, and which facilitates control of the evaporation amount. Also, Japanese Unexamined Utility Model Publication No. 62-117437 discloses a humidifying method employing a heater wire. In the disclosed construction, the heater wire is wound around or inserted into a hollow tube formed of a "GOATEX" brand blended product of nylon and polyurethane which is known for its high water repellent property with water vapor permeability. The "GOATEX" brand product utilizes a hydrophobic property of the blended yarn for achieving the water repellent property of the cloth. Therefore, in the shown construction, the heater wire heats all of the water within the hydrophobic and vapor permeable hollow tube. When the heater wire is wound on the outer periphery of the hollow tube, the heater wire must heat the water within the hollow tube via the peripheral wall which is heat non-conductive. Therefore, it takes a long period of time for heating and, thus, a response from initiation of a power supply for the metal wire to beginning the evaporation of the water is quite low. Furthermore, the amount of the water to be heated by the metal wire as the heater wire is much greater than that in the case of a thin water film, so that thermal inertia is substantially large requiring a long period of time for varying the water evaporation amount from a variation of the heating amount. In addition, the water vapor generated by heating the water within the hollow yarn passes the wall portion of the hollow tube. For a large resistance of the wall portion of the hollow yarn to the water vapor, it is not possible to supply the water vapor corresponding to the discharge amount of the water. Therefore, the vapor amount to be discharged to the atmosphere for conditioning the environmental air cannot be accurately controlled.

SUMMARY OF THE INVENTION

In order to accomplish the above-mentioned and other objects, according to one aspect of the invention, there is provided a humidifier characterized by:

upper and lower water tanks supported by a support frame, a plurality of hollow yarn bodies which are arranged in communication with the upper and lower water tanks, and which each have a thin metal wire that is connected to a power source, wound on the external surfaces thereof.

With the construction set forth above, by passing the water through the hollow yarn body and supplying electric power to the metal wire, the water effusing to the external peripheral wall surface of the hollow yarn bodies is heated and evaporated. In this case, the water can be directly and uniformly distributed through the yarn of each hollow yarn body and directly heated by the heater. Accordingly, supply of the water can be achieved quickly and in large amounts. Also, the water supply amount can be precisely controlled. In addition, a humidifier having a capacity to supply a large amount of water, can be rendered compact through the use of the hollow yarn bodies. Therefore, the humidifier employing such hollow yarn bodies can perform humidification quickly and in large amounts, and the humidification control can be achieved with high precision.

According to a second aspect of the invention, there is provided a hollow yarn body formed by winding a thin metal wire which acts as a heating element on the outer periphery of a hollow yarn body formed of woven of fiber.

Preferably, the material of the fiber forming said hollow yarn may be a material having both heat resistance and hydrophilic properties. The material can be selected among polyester, polyamide, aromatic polyamide, polyimide, glass, quartz glass, alumina, silica alumina, acryl, polypropylene, aromatic polyester, cellulose and so forth.

Also, on the external peripheral surface of the hollow yarn, one or more metal wires which serve as heating elements may be wound in spiral or helical fashion.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but for explanative purposes.

In the drawings.

BEST MODE FOR IMPLEMENTING THE INVENTION

The preferred embodiment of a humidifier and a hollow yarn body according to the present invention will be discussed with reference to FIGS. 1 to 5.

(1) Description of Humidifier Employing Hollow Yarn Body

Figure 1:
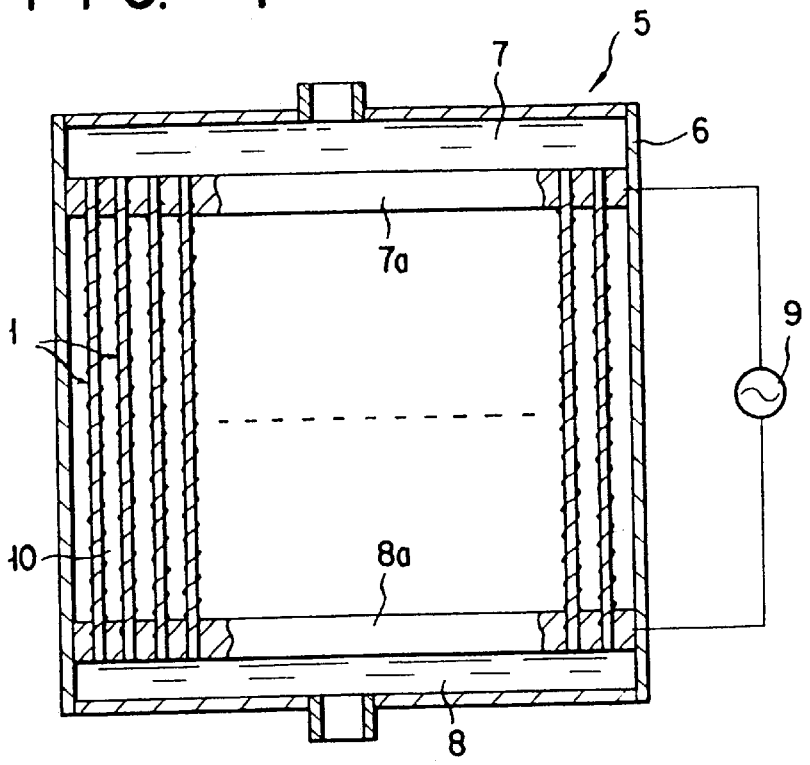
FIG. 1 is a section showing a humidifier according to the present invention.

FIG. 1 shows a humidifier 5 constructed with a large number of hollow yarn bodies 1.

Between opposing wall portions 7*a* and 8*a* of upper and lower water tanks 7 and 8 which are supported on a support frame 6, are a large number of hollow yarn bodies 1. The upper and lower ends of each hollow yarn body 1 are respectively communicated with the water tanks 7 and 8. Both wall portions 7*a* and 8*a* are formed of an electrically conductive material. A power source 9 is connected across the wall portions 7*a* and 8*a* so that electric power is supplied to a metal wire 3 serving as a heater for each individual hollow yarn body 1. Between the wall portions 7*a* and 8*a*, an air flow passage 10 is defined. Each of the hollow yarn bodies 1 is exposed to the air flowing through the air flow passage 10.

(2) Description of a Hollow Yarn Body

Figure 2:
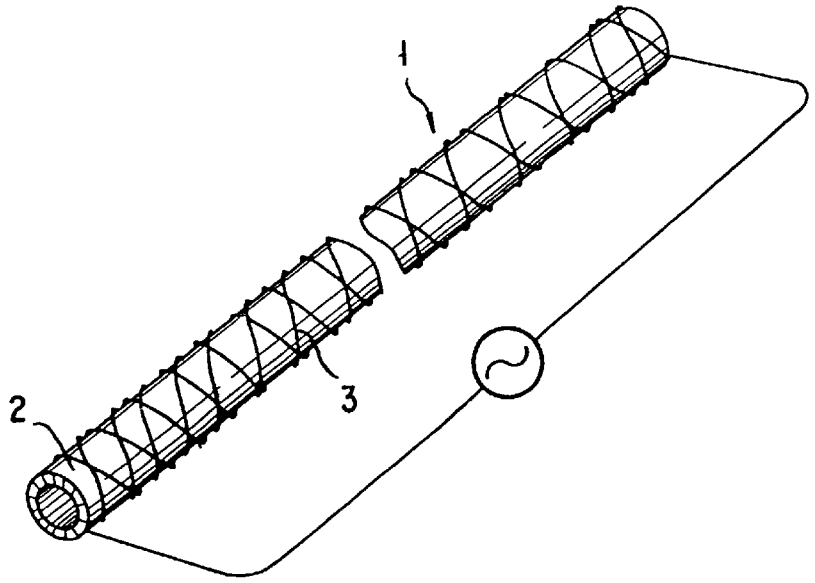
FIG. 2 is a perspective view showing a hollow yarn body according to the present invention.

As shown in FIG. 2, each of the hollow yarn bodies 1 is constituted by a hollow yarn weave or substrate 2 and the thin metal wire 3 which is wound around the external peripheral wall surface of the hollow yarn 2 and which serves as a heater. The hollow yarn substrate 2 has a porous yarn wall formed by weaving long fiber filaments together. For the purposes of description, the inner side of the hollow portion of the hollow yarn wall will be referred to as internal peripheral wall surface 2*a* and the outer side will be referred to as external peripheral wall surface 2*b*.

The long fiber filament forming the hollow yarn 2. is (1) required to have high hydrophilic property for permitting penetration of a large amount of water; (2) required to have a heat resistance since the metal wire 3 is wound directly on the external periphery; and is (3) required to exhibit a flexibility which allows stranding and weaving of the hollow yarn 2.

Figure 3:
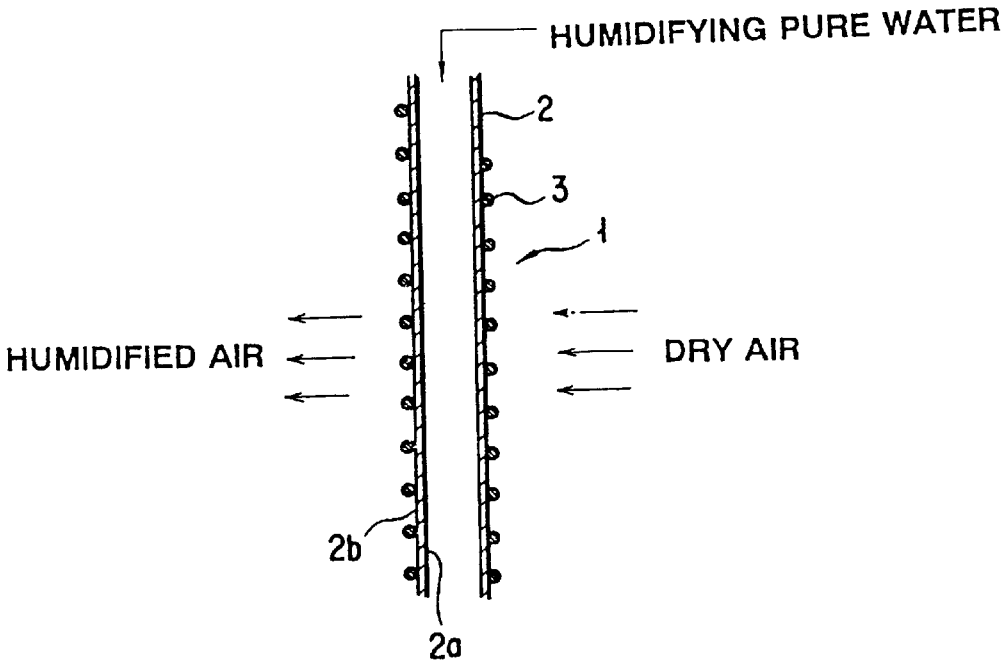
FIG. 3 is an explanatory illustration showing the humidifying function of a hollow yarn body.
Figure 4:
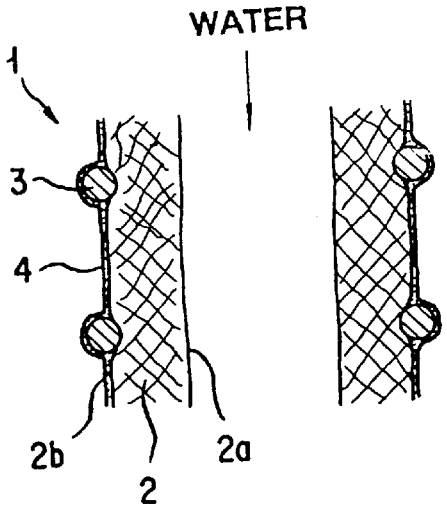
FIG. 4 is an enlarged section showing the condition where a water film is formed on the external wall surface of the hollow yarn body.

As shown in FIGS. 3 and 4. when the water passes through the hollow space of the hollow yarn body 1 due to the high hydrophilic property of the long fiber filament forming the hollow yarn 2. the water, under the influence of its own surface tension, penetrates into the hollow yarn wall from the internal peripheral wall surface 2*a* toward the external peripheral wall surface 2*b* along the surface of the filaments. Then, due to the surface tension of the water, a thin water film 4 is formed on the external peripheral wall surface 2*b* of the hollow yarn 2 and over the surface of the metal wire 3 wound around the external peripheral wall surface 2*b*. Thus, when the metal wire 3 is heated by power supply, the water forming the water film 4 is quickly heated and evaporated. At this time, by blowing dry air over the hollow yarn body 1. the dry air becomes humidified through the inclusion of the water vapor.

The amount of water evaporation can be controlled by regulating the power supply (heating amount) to the metal wire 3. The power supply can be regulated based on the amount and a temperature of air to be blown over each hollow yarn body 1. the initial humidity of the air, etc.

An absolute water evaporation amount by the hollow yarn body 1 can be adjusted by varying the structure of the hollow yarn 2 (internal diameter, external diameter, hollow yarn wall thickness, weaving density and so forth), and hydrophilic property of the long fiber filament, manner of winding of the metal wire and so forth.

It should be appreciated that since the hollow yarn 2 is prepared by weaving long, thin fiber filaments, it is possible that even a small amount of impurity can cause blockage. Therefore, it is preferred that the water which is supplied into the hollow space of the hollow yarn 2 is pure or distilled water.

As shown in FIG. 4, the hollow yarn 2 is fabricated from a plurality of heat resistive, hydrophilic and flexible long fiber filaments which are woven into string form and by weaving a plurality of stranded strings in twill weave, plain weave or other weaving pattern, into hollow configuration. The hollow yarn 2 has an external diameter in a range of 0.5 to 5.0 mm and an internal diameter in a range of 0.4 to 4.5 mm.

The long fiber filament is required to have a flexibility sufficient for stranding and weaving during the fabrication process.

As the material which have hydrophilic property, heat resistance and flexibility, acryl, polyester, polypropylene, polyamide, aromatic polyamide, polymide, aromatic polyester, cellulose, glass fiber, ceramic fiber made of alumina and so forth are suitable.

The metal wire 3 to be wound around the hollow yarn 2 has a diameter in a range of 0.008 to 0.1 mm and as the material thereof, metals for heater, such as copper, stainless, tantalum, nichrome, titanium, nickel, platinum, gold and so forth are suitable.

The metal wire 3 is wound around the hollow yarn 2 in spiral fashion in the case of single wire, and in alternately intersecting fashion in the case of two or more wires (e.g., eight wires).

In connection with the winding of the metal wire 3. if a gap occurs between the external peripheral surface of the hollow yarn 2 and the metal wire 3. the heat energy produced by power supply cannot act effectively and can be a cause of local heating which inhibits precise humidity control. Accordingly, it is preferred to minimize any gaps which may form.

Furthermore, when the hollow yarn 2 is fabricated by a weaving pattern such as twill weaving, the hollow yarn 2 may be expanded when a vertical (longitudinal) force is applied. Such hollow yarn 2 can therefore be installed in the humidifier 5 with stretching in the longitudinal direction. In this case however, if the hollow yarn 2 is expanded, blocking of the pore of the hollow yarn 2 or reducing of the hollow yarn wall thickness or variation of the internal and external diameter of the hollow yarn 2 may be caused. Also, if the external diameter is reduced, a gap may be defined between the external wall of the hollow yarn and the metal wire 3 wound around the external wall of the hollow yarn may be formed to degrade tightness of fitting of the metal wire against the hollow yarn body. When such a situation occurs, humidification performance of the hollow yarn 1 is lowered and high precision humidification control becomes impossible.

However, the expansion in the longitudinal direction can be reduced by increasing number of metal wires 3 wound in alternately intersecting manner on the hollow yarn 2. Accordingly, it is advisable to use at least a minimum number of wires 3 which can suppress expansion of the hollow yarn 2 in the longitudinal direction.

It should be appreciated that when the metal wires 3 are wound in alternately intersecting manner, the intersecting metal wires 3 mutually depress the other onto the external peripheral surface of the hollow yarn 2, and it is unnecessary to use a bond for preventing the formation of gaps between the external peripheral surface of the hollow yarn 2 and the metal wires 3. In such instances, the heat of the metal wires can be transmitted to the water without being blocked by the bond. Also, since such a bond should not be permitted to enter into the hollow yarn in a manner which invites blocking of the woven body, winding of the metal wire in an alternately intersecting manner is advantageous.

By employing the hollow yarn body 1 as set forth above, the following features may be attained.

(1) despite a compact size, evaporation (humidification) of large amounts of water can be performed;

(2) the change in water evaporation in response to power supply variation becomes very high;

(3) water evaporation control through power supply control is facilitated (proportional controlcan be performed) and humidification control can be performed with high precision and high stability;

(4) the range of water evaporation (humidification) control is widened;

(5) high security is provided ; and (6) constant temperature humidification becomes possible.

As set forth above, in order to perform humidification, the water is past through the hollow portion of the hollow yarn 2 and power is brought into contact with the metal wire 3 to cause evaporation of the water. By introducing the generated water vapor into the dry air, the dry air can be humidified.

Here, the principle of penetration of the water within the hollow yarn 2 and the principle of evaporation of the penetrated water will be discussed.

By making the long fiber filament forming the hollow yarn 2 from a material having a high hydrophilic property, wetting ability of the hollow yarn 2 to be water can be maintained at a high level. Namely, when the water is past through the hollow spaces in the hollow yarn 2. the water penetrates from the internal peripheral wall surface 2*a* to the external peripheral wall surface 2*b* through the hollow yarn wall. This is caused by transmission of water along the surface of the filament under capillarity action. Then, the water which reaches the external peripheral wall surface 2*b* forms a thin water film 4 on the external peripheral wall surface 2*b* of the hollow yarn 2 and on the metal wires 3 wound on the external peripheral wall surface due to its own surface tension.

At this time, by heating the metal wires 3 by supplying power thereto, the water film 4 is converted into water vapor. Thus, the water forming the film 4 is directly heated on the surface of the metal wires 3 and instantly evaporated.

Even when the water is evaporated on the external peripheral wall surface 2*b* and the metal wire 3. since the long fiber filament has a high hydrophilic property, water is supplied from the internal peripheral wall surface 2*a* to the external peripheral wall surface 2*b* in continuous manner. Thus, as the water evaporates from the surface of the metal wire 3. it is continuously replenished.

In addition, the uniform supply of the water to the external peripheral wall surface 2*b* can be achieved. As the water supply is achieved by capillary action, no localized lack or excess of water will occur. Accordingly, the water can be stably and uniformly supplied to the surface of the external peripheral wall surface 2*b* and the surface of the metal wire 3.

The hollow yarn body 1 according to the present invention is formed by winding thin metal wire 3 on thin hollow yarn 2. Therefore, the surface area of the metal wire 3 for causing evaporation of the water is relatively large. Also, the hollow yarn 2 serving to supply the water is woven from a large number of very thin long fiber filaments. Accordingly, the surface area of the long fiber filaments for conveying the water by capillary action is sufficient to ensure the supply of water.

For the two reasons set forth above, while the hollow yarn body 2 can be fabricated into compact size, large amount of water supply and large amount of evaporation of water can be certainly achieved.

Furthermore, since the evaporation of the water is performed on the surface of the metal it can be performed by "direct heating". Also, it is sufficient to supply the water from the inside of the hollow yarn 2 in the amount necessary for evaporation. Therefore, it becomes unnecessary to store a large amount of water in the humidifying element c as in the previously discussed prior art. Also, the water reservoir h as required in the latter prior art becomes unnecessary. Furthermore, since the long fiber filament has a high hydrophilic property, the penetration of the water from the internal peripheral wall surface 2*a* to the external peripheral wall surface 2*b* of the hollow yarn 2 is very rapid. Accordingly, a vessel to store the water. is substantially unnecessary. Therefore, the wall of the hollow yarn can be thin. Thus, the hollow yarn 2 can be made compact.

With the three reasons set forth above, the hollow yarn body 1 constituted of the hollow yarn 2 and the metal wire 3*c* can provide large evaporation amount while the overall humidifier can be made compact.

Further, as set forth above, evaporation of water is caused by direct heating of the water at the surface of the metal wire 3. Therefore, heat is not transmitted through a plurality of stages, such as "heater f→environmental air→case e→filter material b→water" as in the previously discussed prior art. Heating of a large amount of water by an immersed heater, as in the second of the above-discussed prior art arrangement, is not necessary.

In the hollow yarn body 1 according to the present invention, the metal wire 3 only heats the water forming the thin film 4 on the surface of the metal wire to instantly cause evaporation of the water. Namely, the energy of the metal wire 3 is directly transmitted to the water. Accordingly, the humidifier employing the hollow yarn body 1 according to the present invention exhibits a high response speed and quickly starts evaporating water following the supply of electrical power.

Furthermore, since the film of water present on the surface of the metal wire 3 is quite thin and is formed by the effect of surface tension, the-thermal inertia caused by the metal wire 3 and the water forming the thin film 4 on the surface of metal wire, is quite small.

Therefore, by varying the amount of heating, the evaporation amount can be varied instantly. Accordingly, when the evaporation amount of the water is desired to be varied, it can be achieved by varying power supply for the metal wire 3. The response of variation of the evaporation amount of the water relative to variation of the heating amount is quite high.

As mentioned above, what is associated with evaporation of the water is the temperature of the metal wire 3 and the quite small amount of water on the surface of the metal wire 3. Accordingly, water evaporation amount control by power supply can be performed easily (can be performed proportional control) with high precision.

Also, supply of the water to the external peripheral surface 2*b* of the hollow yarn is performed from the overall internal peripheral wall surface 2*a* to the overall external peripheral wall surface 2*b* and by the capillary effect. Therefore, localized shortages of water are prevented as compared with the former prior art. Accordingly, the water can be constantly, stably and uniformly supplied to the external peripheral wall surface. Also, the metal wire 3 can be uniformly heated.

Accordingly, when the water amount and the heating are uniform, proportional control with these parameters can be performed and thus permits high precision and stable control.

As set forth above, the humidifier 5 employing the hollow yarn body 1 according to the present invention, can evaporate large amounts of water. Furthermore, it is possible to induce only a small amount evaporation by controlling the power supply amount. Accordingly, the water evaporation amount (humidifying amount) can be arbitrary set anywhere between a large amount and a small amount. Namely, a humidity control range can be quite wide.

As set forth above, the water can be constantly and uniformly supplied to the external peripheral wall surface 2*b* with stability, local shortages of water will never be avoided. Accordingly, abnormal local heating as in the former prior art will be avoided to assure safe operation.

It is possible to perform control so that all of the heat energy generated by power supply to the metal wire 3 forms water vapor. Accordingly, no extraneous heat energy will be imparted to the air passing through the humidifier by the metal wire 3. Namely, constant temperature humidification which results only in humidification can be performed.

Next, discussion will be given for an example of implementation of the humidifier 5 with the construction shown in the following table I.

TABLE I

| CONSTRUCTION ITEM | | | Embodiment 1 | Embodiment 2 | Embodiment 3 |
|---|---|---|---|---|---|
| Hollow Yarn Body | Hollow Yarn | Long Fiber Filament Material | Polyester | Heat Resistive Glass Fiber | Silica Almina |
| | | Long Fiber Filament | 250 denyl | ← | 10$\mu$ |

TABLE I-continued

Figure 5:
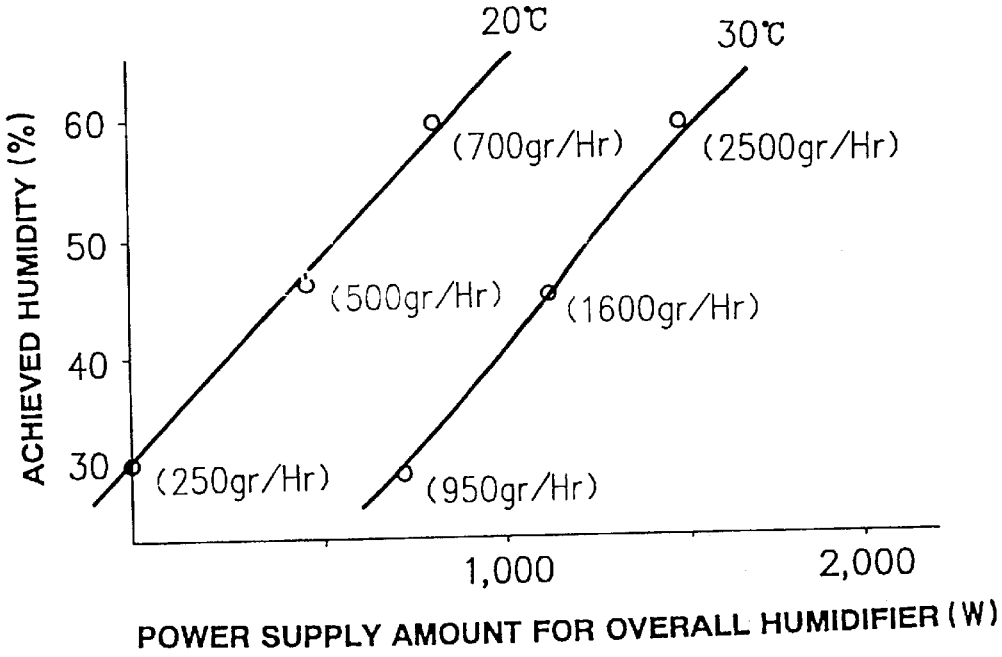
FIG. 5 is a chart showing the humidity versus power supply amount achieved with the humidifier according to the present invention.
Figure 6:
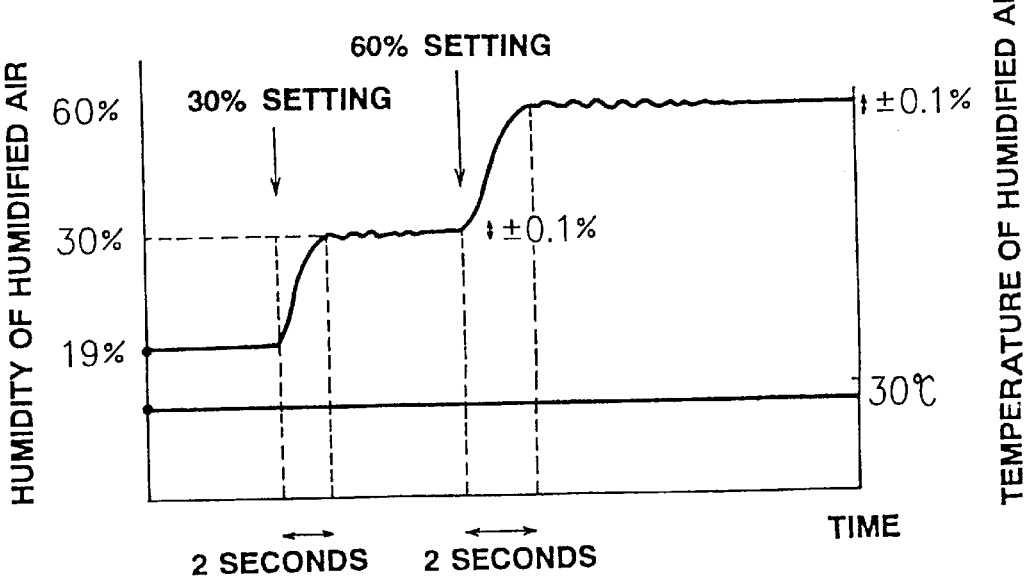
FIG. 6 is a chart showing the performance of the humidifier in terms of the humidity of the humidified air versus time.
Figure 7:
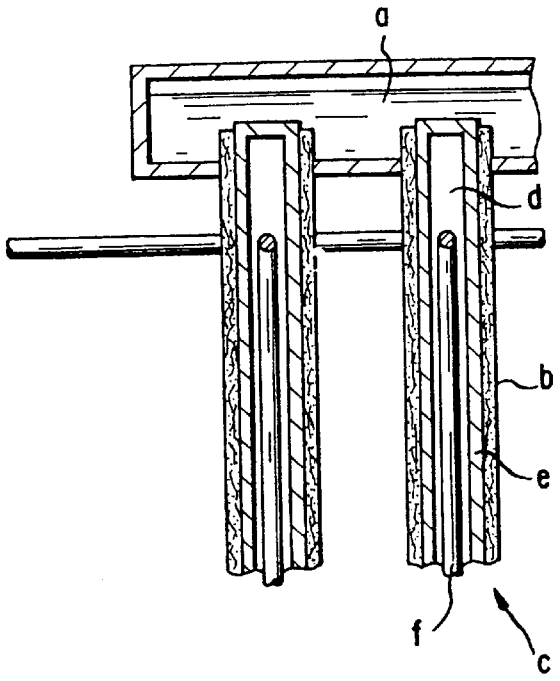
FIG. 7 PRIOR ART
FIG. 7 is a section showing a part of the first prior art discussed in the opening paragraph s of the disclosure.
Figure 8:
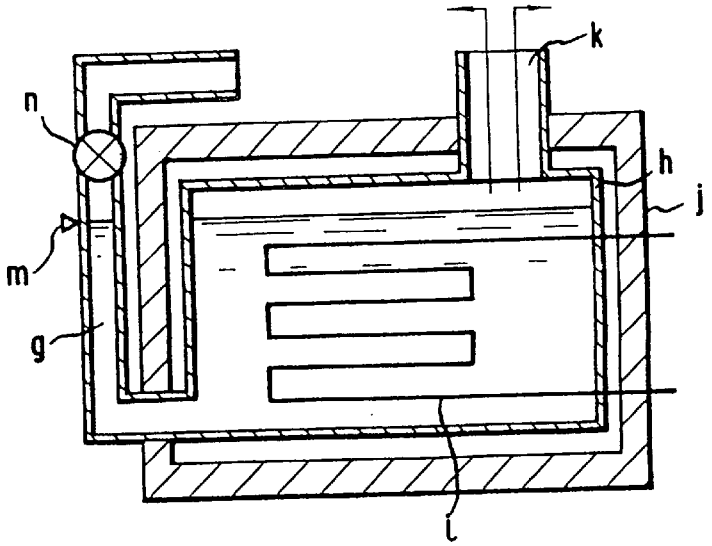
FIG. 8 PRIOR ART
FIG. 8 is a fragmentary section showing the second prior art discussed in the opening paragraphs of the disclosure.

| CONSTRUCTION ITEM | | | Embodiment 1 | Embodiment 2 | Embodiment 3 |
|---|---|---|---|---|---|
| | | Thickness | | | |
| | | Number of Filament Forming String | 48 filaments | ← | 1000 filaments |
| | | Number of String Forming Hollow Yarn | 48 strings | ← | 24 strings |
| | | Weaving Pattern | Twill | ← | ← |
| | | Hollow Yarn External Diameter | 1.6 mm | ← | 2.0 mm |
| | | Hollow yarn Internal Diameter | 1.0 mm | ← | 1.2 mm |
| | Metal Wire | Material | Stainless | ← | Nichrome |
| | | Thickness | 0.03 mm | ← | 0.05 mm |
| | | Number | 8 | ← | 4 |
| | | Winding Pattern | Alternately Intersecting | ← | ← |
| | | Electrical Resistance | 3.5 Ω/cm | 6.5 Ω/cm | 4.7 Ω/cm |
| Humidifier | Construction | Hollow Yarn Body External Surface Area | 307 $cm^2$ | ← | ← |
| | | Hollow Yarn Body Overall Length | 612 cm | ← | ← |
| | | Hollow Yarn Body Number | 36 | ← | ← |
| Humidifying Performance | | | FIGS. 5, 6 | ← | |

(Embodiment 1)

With the construction shown in the table I, the hollow yarn body 1 and the humidifier 5 were prepared. The humidifying performance of the humidifier thus constructed is shown in FIGS. 5 and 6.

In FIG. 5, there is shown a relationship of the achieved humidify obtained by varying the power supply amount when initial humidity is 19%, and air of 20° C. and 30° C. is past through the humidifier 5. The value in the parenthesis represents water evaporation amount from the humidifier at that time.

As can be clear from FIG. 5, by proportional control of the power supply to the metal wire 3. the water evaporation amount can be accurately controlled. At this time, for all temperatures of the air passing through the humidifying device, proportional control of the power supply amount is possible. Also, the water evaporation amount is varied depending upon respective set values. observing the water evaporation amount, at 30° C. and 60%, for example, 2,500 gr/Hr was achieved. This, it can be appreciated that the present invention permits large evaporation amount with a compact device.

When 3000 durability test was performed, no variation of the characteristics occurred.

FIG. 6 shows the elapsed time when air having initial humidify of 19% and initial temperature of 30° C. is passed through the humidifier under the conditions wherein the achieved humidity is controlled at 30% and 60%.

As can be seen from FIG. 6, the desired humidity was achieved after approximately 2 seconds from setting of the power supply amount to achieve a humidity 30%. Also, as shown, it takes approximately 2 seconds to vary the humidity from 30% to 60%.

As set forth above, it should be appreciated that response speed from setting of the humidity to achievement of the set humidity is quite high.

Furthermore, in observation of the achievement condition, it falls within a range of ±0.1%. This, high precision humidity control can be achieved.

(Embodiment 2)

With the construction shown in the embodiment 2 in the foregoing table I, the hollow yarn body 1 and the humidifier 5 were prepared. The humidifying performance of thus prepared humidifier 5 was substantially the same as the embodiment 1. Here, the heat resistant glass having MgO, $Al_2O_3$, $SiO_2$ as primary component was used.

In this embodiment, in order to check the safety of the invention upon a temporary failure of the water supply or loss of air flow, supply water to the humidifier 5 was cut off and power at 7OW (252OW for overall humidifier) per each hollow yarn body 1 was supplied for 100 hours. As a result, while the hollow yarn 1 became heated to approximately 400° C. to 600 ° C. no melting or deformation of the hollow yarn was not observed. Accordingly, it should be appreciated that the hollow yarn body 1 is superior in viewpoint of heat resistance and safety. Thereafter, characteristics of the power supply amount and the humidifying control were checked with the water supply re-established. The performance of the device was satisfactory.

(Embodiment 3)

Also, with the construction shown in the embodiment 3 of the foregoing table I, the hollow yarn body 1 and the humidifier 5 were prepared. Here, as silica almina, one containing $Al_2O_3$ and $SiO_2$ as primary component was used.

In this embodiment, in order to check durability, with supply water to the humidifier 5. power was supplied at 3000W for 3000 hours. At this time, the humidification amount of 3800 gr/Hr remained constant for 3000 hours and no variation of the characteristics was observed. Accordingly, it has confirmed that the shown embodiment of the humidifier 5 has high durability.

On the other hand, in order to check security upon temporary failure of the water way, with no supply water to the humidifier 5. power at 7OW (252OW for overall humidifier) per each hollow yarn body 1 was supplied for 150 hours. As a result, while the hollow yarn 1 achieved high temperature of approximately 400° C. to 600° C. no melting or deformation of the hollow yarn was caused. Accordingly, it should be appreciated that the hollow yarn body 1 is superior in viewpoint of heat resistance and security. Thereafter, characteristics of the power supply amount and the humidifying control were checked by re-establishing the water supply. The performance did not differ from that at initial state.

As will be clear from the results of the embodiments 1, 2 and 3. the humidifier 5 according to the present invention can quickly generate large amount of water vapor to permit quick and high precision humidification.

It should be noted that as demonstrated by embodiments 2 and 3. hollow yarn can withstand heat for a long period even in the state where no water is supplied. It is also possible to employ the device as a heater instead of a humidifier.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

INDUSTRIAL APPLICABILITY

As set forth above, the humidifier according to the present invention and the hollow yarn bodies are quite effective as a humidifier and can be employed in an air conditioner in semiconductor fabrication plants and clean rooms.

What is claimed is:

1. A humidifier comprising:

upper and lower water tanks supported between the upper and lower water tanks by a support frame;

a plurality of hollow yarn bodies formed of a heat resistant and hydrophilic material which fluidly communicates with the upper and lower water tanks, each of said hollow yarn bodies having an external surface which is exposed to a flow of air and forming a thin water film on said external surface; and a plurality of thin metal heater wires adapted for connection to a power source, each of said thin metal heater wires being disposed on the external surface of a hollow yarn body for heating said thin water film on said external surface for promoting evaporation therefrom.

2. A hollow yarn body as set forth in claim 1, wherein a surface tension of the water is used to maintain a film of water over the surface of said thin metal heater wires.

3. A hollow yarn body formed by winding a thin metal wire as a heater on an outer periphery of a hollow yarn formed by weaving of a fiber of a heat resistant and hydrophilic material, wherein said heater promotes evaporation of a fluid film formed on said outer periphery of said hollow yarn.

4. A hollow yarn body as set forth in claim 3, wherein the material of the fiber forming said hollow yarn is a material having heat resistance and hydrophilic property, selected among aromatic polyamide, polyimide, glass, quartz glass, alumina, silica alumina, and aromatic polyester.

5. A hollow yarn body as set forth in claim 2, wherein on the external peripheral surface, one or more metal wires serving as a heater, are wound in spiral fashion.

6. A hollow yarn body as set forth in claim 3, wherein the external diameter of said hollow yarn is 0.5 to 5.0 mm, an internal diameter is 0.4 to 4.5 mm, and the metal wire has a diameter of 0.008 to 0.1 mm.

7. A hollow yarn body as set forth in claim 3, wherein, on the external peripheral surface, an even number of metal wires serving as a heater, are wound in an alternately intersecting manner.

8. A humidifier comprising:

upper and lower water tanks supported between the upper and lower tanks by a support frame;

a plurality of tubular bodies formed of a heat resistant and hydrophilic yarn, said tubular bodies fluidly communicating with the upper and lower water tanks so that a hollow interior of each of said tubular bodies is constantly filled with water, each of said tubular bodies having an external surface which is exposed to a flow of air and forming a thin water film on said external surface of tubular bodies; and a plurality of thin metal heater wires adapted for connection to a power source, each of said thin metal heater wires being disposed on the external surface of a hollow yarn body so as to be covered with a thin film of water, said film being maintained by surface tension in the water and heated by said heater wires for promoting evaporation.

9. A humidifier comprising:

a plurality of woven tubular bodies formed of a heat resistant and hydrophilic yarn, said tubular bodies fluidly communicating with a source of water so that a hollow interior of each of said tubular bodies is constantly filled with water, each of said tubular bodies having an external surface which is exposed to a flow of air and forming a thin water film on said external surface; and a plurality of thin metal heater wires adapted for connection to a power source, each of said thin metal heater wires being disposed on the external surface of a hollow yarn body so that surface tension in the water maintains the wires covered with the thin film of water, said film being heated by said heater wires for promoting evaporation therefrom.

* * * * *